US009060394B2

(12) United States Patent
Ando et al.

(10) Patent No.: US 9,060,394 B2
(45) Date of Patent: Jun. 16, 2015

(54) LIGHTING DEVICE, METHOD OF CONTROLLING THE SAME, AND LIGHTING SYSTEM

(71) Applicant: Panasonic Corporation, Osaka (JP)

(72) Inventors: Tamotsu Ando, Osaka (JP); Tatsumi Setomoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/262,256

(22) Filed: Apr. 25, 2014

(65) Prior Publication Data

US 2014/0368115 A1 Dec. 18, 2014

(30) Foreign Application Priority Data

Jun. 12, 2013 (JP) ..... 2013-124128

(51) Int. Cl.
*G08B 5/22* (2006.01)
*H01J 1/60* (2006.01)
*H05B 37/02* (2006.01)

(52) U.S. Cl.
CPC ..... *H05B 37/0272* (2013.01)

(58) Field of Classification Search
USPC ..... 315/34, 129; 340/4.61, 4.62, 5.61, 340/426.13; 398/130, 140
See application file for complete search history.

(56) References Cited

U.S. PATENT DOCUMENTS

| | | | | |
|---|---|---|---|---|
| 8,350,479 | B1 * | 1/2013 | Brazille, II | 315/34 |
| 2013/0033178 | A1 * | 2/2013 | Huang | 315/86 |

FOREIGN PATENT DOCUMENTS

| | | | |
|---|---|---|---|
| JP | 56-164966 | A | 12/1981 |
| JP | 07-272866 | A | 10/1985 |
| JP | 04-092391 | A | 3/1992 |
| JP | 3071173 | U | 6/2000 |
| JP | 2006-277140 | A | 10/2006 |
| JP | 2009-017267 | A | 1/2009 |
| JP | 2013-020903 | A | 1/2013 |

* cited by examiner

*Primary Examiner* — Minh D A
(74) *Attorney, Agent, or Firm* — Renner, Otto, Boisselle & Sklar, LLP

(57) ABSTRACT

A lighting device which includes: a light source; a receiving unit which receives a control signal from outside the lighting device via wireless communication; and a control unit which causes the light source to emit light according to the control signal received by the receiving unit. When the receiving unit receives, from the outside the lighting device via the wireless communication, a test signal different from the control signal and for determining a state of the wireless communication, the control unit calculates a packet error rate of the test signal received by the receiving unit and causes the light source to emit light such that an emission state is changed according to a communication quality of the wireless communication determined based on at least the calculated packet error rate.

18 Claims, 11 Drawing Sheets

LIGHTING DEVICE, METHOD OF CONTROLLING THE SAME, AND LIGHTING SYSTEM

CROSS REFERENCE TO RELATED APPLICATION

The present application is based on and claims priority of Japanese Patent Application No. 2013-124128 filed on Jun. 12, 2013. The entire disclosure of the above-identified application, including the specification, drawings and claims is incorporated herein by reference in its entirety.

FIELD

The present invention relates to lighting control devices, and particularly relates to a lighting device controlled via wireless communication.

BACKGROUND

In recent years, a lighting device includes light-emitting diodes (LEDs) as light sources. In particular, an LED lamp is gaining attention as an illumination light source substitute for conventional fluorescent and incandescent bulbs.

There are various conventional methods of controlling lighting devices, such as a control with a remote controller (for example, see Patent Literature (PTL) 1.

CITATION LIST

Patent Literature

[PTL1] Japanese Unexamined Patent Application Publication No. 2006-277140

SUMMARY

Technical Problem

In the case where a lighting device is installed which is controlled via wireless communication, it is desirable to install the lighting device at a place that has high-quality wireless communication to prevent wireless communication failure from occurring after the installation.

One non-limiting and exemplary embodiment provides a lighting device and the like which can be easily installed by a user at a place that has high-quality wireless communication.

Solution to Problem

In order to achieve the above object, a lighting device according to an aspect of the present invention is a lighting device which includes: a light source; a receiving unit which receives a control signal from outside the lighting device via wireless communication; and a control unit which causes the light source to emit light according to the control signal received by the receiving unit. When the receiving unit receives, from the outside the lighting device via the wireless communication, a test signal different from the control signal and for determining a state of the wireless communication, the control unit calculates a packet error rate of the test signal and causes the light source to emit light such that an emission state is changed according to a communication quality of the wireless communication determined based on at least the calculated packet error rate.

For example, it may be that when the receiving unit receives the test signal, the control unit further detects a signal intensity of the test signal, and the communication quality is determined based on the packet error rate calculated by the control unit and the signal intensity detected by the control unit.

For example, it may also be that when the receiving unit receives the test signal, the receiving unit further receives the test signal plural times, and the communication quality is further determined based on a total number of times the test signal is properly received by the receiving unit.

For example, it may also be that when the packet error rate calculated by the control unit is higher than a predetermined value, the communication quality is determined to be higher for a lower value of the calculated packet error rate, and when the packet error rate calculated by the control unit is lower than or equal to the predetermined value, the communication quality is determined to be higher for a higher value of the detected signal intensity.

For example, it may also be that when the calculated packet error rate is higher than 0, the communication quality is determined to be higher for a lower value of the packet error rate calculated by the control unit, and when the packet error rate calculated by the control unit is 0, the communication quality is determined to be higher for a higher value of the detected signal intensity.

For example, it may also be that the emission state is indicated by a luminance of the light source, and the control unit causes the light source to emit light such that the luminance is changed according to the communication quality.

For example, it may also be that the emission state is indicated by a blinking interval of the light source, and the control unit causes the light source to emit light such that the blinking interval is changed according to the communication quality.

For example, it may also be that the emission state is indicated by a color temperature of the light source, and the control unit causes the light source to emit light such that the color temperature is changed according to the communication quality.

For example, it may also be that the control unit causes the light source to emit light such that the emission state is changed in a stepwise manner according to the communication quality.

For example, it may also be that the lighting device further includes a plurality of the light sources, and that the emission state is indicated by a total number of the light sources that are caused to emit light, and the control unit changes, according to the communication quality, the total number of the light sources that are caused to emit light.

For example, it may also be that the control unit changes, according to the communication quality, a portion of the light source which emits light.

For example, it may also be that the light source is a straight tube light-emitting diode (LED) lamp, and the control unit increases or decreases the portion of the light source which emits light, from one end to the other end of the light source, as the communication quality increases.

For example, it may also be that the control unit causes the light source to emit light by outputting a pulse width modulation (PWM) signal.

For example, it may also be that the lighting device further includes a terminal for a user to obtain information indicating the communication quality.

For example, it may also be that the control unit outputs a DC voltage according to the communication quality to the terminal as the information indicating the communication quality.

For example, it may also be that the receiving unit receives the control signal and the test signal via the wireless communication of an ultra high frequency (UHF) band and a super high frequency (SHF) band.

Furthermore, a control method according to an aspect of the present invention is a method of controlling a lighting device which externally receives a control signal via wireless communication and emits light according to the received control signal. The method includes, when the lighting device receives, via the wireless communication, a test signal different from the control signal and for determining a state of the wireless communication: calculating a packet error rate of the test signal received by the lighting device; and causing the lighting device to emit light such that an emission state is changed according to a communication quality of the wireless communication determined based on at least the calculated packet error rate.

Furthermore, a lighting system according to an aspect of the present invention is a lighting system which includes: a lighting device; and an external control device. The lighting device includes: a light source; a receiving unit which receives a control signal from the external control device via wireless communication; and a control unit which causes the light source to emit light according to the control signal received by the receiving unit. When the receiving unit receives, from the external control device via the wireless communication, a test signal different from the control signal and is for determining a state of the wireless communication, the control unit calculates a packet error rate of the test signal and causes the light source to emit light such that an emission state is changed according to a communication quality of the wireless communication determined based on at least the calculated packet error rate.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

The present invention allows a user to easily install a lighting device at a place which has good-quality wireless communication.

BRIEF DESCRIPTION OF DRAWINGS

These and other objects, advantages and features of the invention will become apparent from the following description thereof taken in conjunction with the accompanying drawings that illustrate a specific embodiment of the present invention.

Figure 1:
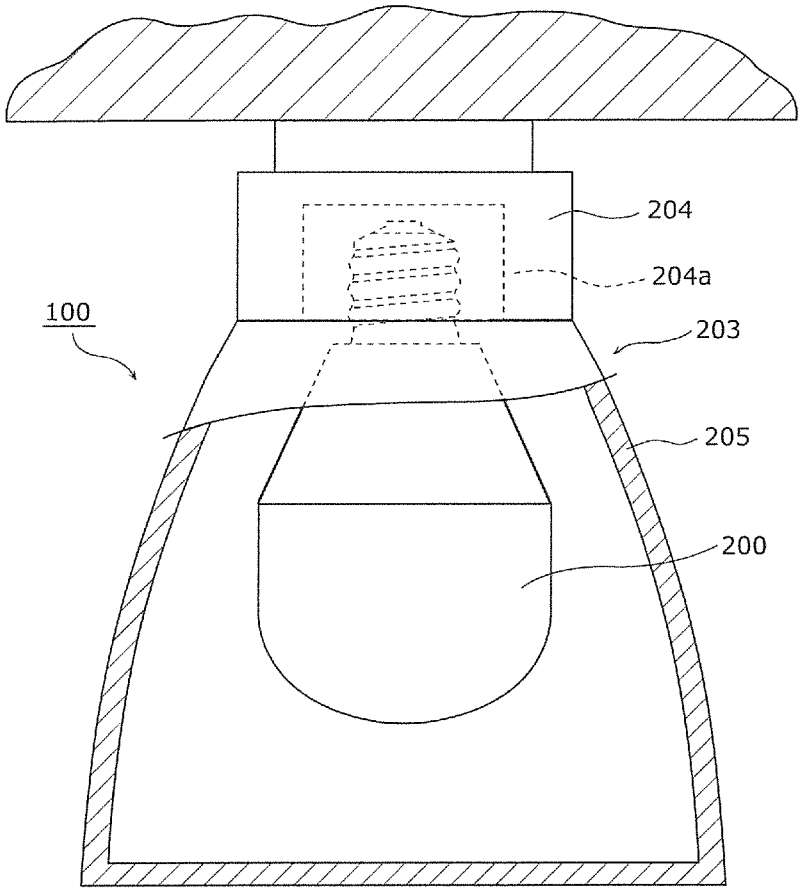
FIG. 1 is an external view of a configuration of a lighting device according to Embodiment 1.

DESCRIPTION OF EMBODIMENTS (Underlying Knowledge Forming Basis of the Present Invention)

In the case where a lighting device is installed which is controlled via wireless communication, it is desirable to install the lighting device a place that has high-quality wireless communication to prevent wireless communication failure from occurring after the installation.

For example, there is a case where a plurality of lighting devices controlled by one external control device (a remote controller) are installed in the ceiling on one floor. In such a case, it is necessary to install the lighting devices so that each light device can establish high-quality wireless communication with the external control device. However, the positional relationship between the external control device and each lighting device is different, and the radio wave condition around each lighting device is also different. Hence, it is difficult to install the lighting devices at the positions where respective lighting devices can establish high-quality communication with the external control device.

In order to determine the communication quality, the intensity (level or amplitude) of a signal received by each lighting device from the eternal control device may be monitored. In high-frequency wireless communication, however, radio wave interference and diffraction are likely to occur in the wireless communication. Hence, the level of signal intensity does not always correspond to the communication quality.

Furthermore, in general, in order to determine the communication quality, a separate device is often necessary for monitoring the communication quality. As a result, there is a demand for a configuration which facilitates determination of the communication quality without requiring a device for determining the communication quality.

In view of this, in a lighting device according to an aspect of the present invention, a control unit determines the communication quality based on at least the packet error rate (PER) of a test signal. This increases accuracy of the communication quality.

Moreover, at the installation of the lighting device according to an aspect of the present invention, light sources, which are caused to emit light as a main function of the lighting device, are caused to emit light in an emission state according to the communication quality. More specifically, a user can easily determine the communication quality with use of a resource included in the lighting device. Furthermore, the user can easily adjust the installation position of the lighting device while visibly checking the emission state of the lighting device.

Hereinafter, exemplary embodiments are described in greater detail with reference to the accompanying Drawings.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Therefore, among the structural elements in the following exemplary embodiments, structural elements not recited in any one of the independent claims are described as arbitrary structural elements.

Embodiment 1

First, a description is given of a configuration of a lighting device according to Embodiment 1. In Embodiment 1, a description is given of a lighting device which includes a light bulb-shaped lamp as an illumination light source.

FIG. 1 is an external view of a configuration of the lighting device according to Embodiment 1.

As illustrated in FIG. 1, a lighting device 100 according to Embodiment 1 is, for example, installed in the ceiling of a room, and includes a light bulb-shaped lamp 200 (illumination light source) and a lighting fixture 203.

The lighting fixture 203 is for turning on and off the light bulb-shaped lamp 200, and includes a fixture body 204 attached to the ceiling, and a light-transmissive lamp cover 205 that covers the light bulb-shaped lamp 200. The fixture body 204 includes a socket 204*a*. The base of the light bulb-shaped lamp 200 screws into the socket 204*a*. AC power is supplied to the light bulb-shaped lamp 200 via the socket 204*a*.

Next, a detailed description is given of the lighting device 100.

Figure 2:
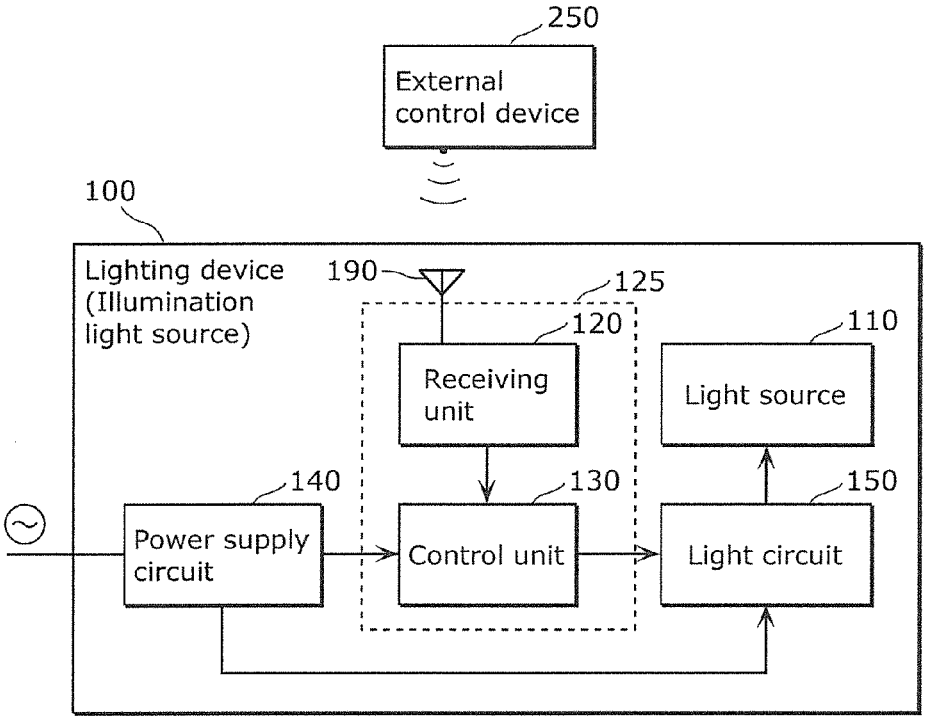
FIG. 2 is a block diagram of a system configuration of the lighting device according to Embodiment 1.

FIG. 2 is a block diagram of a system configuration of the lighting device according to Embodiment 1.

Figure 3:
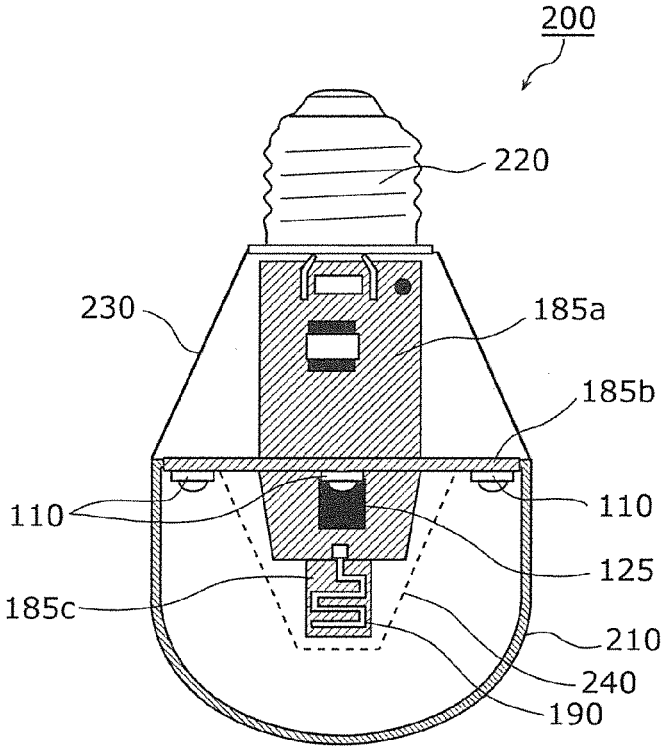
FIG. 3 illustrates a configuration of a light bulb-shaped lamp according to Embodiment 1.

FIG. 3 illustrates a configuration of the light bulb-shaped lamp 200 included in the lighting device 100. FIG. 3 is a perspective diagram visibly illustrating an internal configuration of the light bulb-shaped lamp 200.

As illustrated in FIG. 2 and FIG. 3, the lighting device 100 (the light bulb-shaped lamp 200) includes light sources 110, a receiving unit 120 which receives control signals from outside the lighting device 100 via wireless communication, and a control unit 130 which causes the light sources 110 to emit light according to the control signals received by the receiving unit 120.

The lighting device 100 further includes a power supply circuit 140 and a light circuit 150. In the following descriptions, the receiving unit 120 and the control unit 130 may collectively be referred to as a wireless communication control unit 125.

As illustrated in FIG. 3, the external enclosure of the light bulb-shaped lamp 200 includes a globe 210, a case 230, and a base 220. The external enclosure houses the light sources 110, boards 185*a* to 185*c*, and a circuit case 240.

Each of the light sources 110 is a so-called surface mount device (SMD) LED element. More specifically, the SMD LED element is a packaged LED element which has an LED chip mounted in a resin molded cavity and has phosphor-containing resin encapsulated into the cavity. A plurality of the light sources 110 are mounted on the board 185*b*. Each light source 110 may have, for example, a chip on board (COB) structure where an LED chip is directly mounted on the board 185*b*. The light source 110 may be, for example, a semiconductor light-emitting element such as a semiconductor laser, or any other solid light-emitting element such as an organic electro luminescence (EL) element or an inorganic EL element.

The wireless communication control unit 125 is a so-called wireless module (wireless circuit), and is mounted on the board 185*a*. The wireless communication control unit 125 includes the receiving unit 120 and the control unit 130.

In Embodiment 1, the wireless communication control unit 125 performs communication using ZigBee (registered trademark) that is one of standards of wireless personal area network (WPAN). The communication method performed by the wireless communication control unit 125 may be other than the above. The wireless communication control unit 125 may perform communication via Bluetooth (registered trademark) or wireless local area network (LAN).

The receiving unit 120 receives control signals from outside the lighting device 100 via wireless communication. More specifically, the receiving unit 120 receives control signals from the external control device 250 (remote controller) via an antenna 190 (pattern antenna) mounted on the board 185*c*. The receiving unit120 (wireless communication control unit 125) may include an antenna.

In Embodiment 1, the frequency band of the wireless communication performed by the receiving unit 120 is UHF or SHF, but may be other than UHF and SHF.

The control unit 130 causes the light sources 110 to emit light according to the control signals received by the receiving unit 120. More specifically, the control unit 130 causes each light source 110 to emit light via the light circuit 150 by transmitting a lighting control signal to the light circuit 150. Specific examples of the lighting control signal include a PWM signal, and a chopper control signal such as a PFM signal. The lighting control signal may be other than the above examples.

When the receiving unit 120 receives a test signal from the external control device 250 via wireless communication, the control unit 130 shifts to a test mode. More specifically, the control unit 130 shifts to the test mode when the receiving unit 120 receives a test signal that is different from a control signal and is for determining a state of wireless communication, from outside the lighting device 100 via wireless communication.

In the test mode, the control unit 130 calculates the PER of the test signal received by the receiving unit 120, and causes each light source 110 to emit light such that the emission state is changed according to the quality of the wireless communication determined based on at least the calculated PER. A detailed description is given later of operation of the test mode.

The wireless communication control unit 125 may include a transmitting unit which transmits, to the external control device 250, a response signal used for acknowledging receipt of a test signal, requesting retransmission of a test signal, and the like. The response signal here refers to so-called ACK (acknowledgement) or NAK (negative acknowledgement).

The wireless communication control unit 125 can transmit a signal to the external control device 250 or other devices by the transmitting unit. More specifically, for example, the transmitting unit transmits information indicating communication quality to the external control device 250, and feedbacks the information indicating communication quality to the external control device 250.

The power supply circuit 140 converts AC power to DC power, further converts the DC power to DC power suitable for driving the control unit 130 and the light circuit 150, and outputs the resultant DC power. More specifically, the power supply circuit 140 includes, for example, a diode bridge rectifier circuit which converts AC power to DC power, and a DC-DC converter IC. The power supply circuit 140 is mounted on the board 185*a*. The power supply circuit 140 may be implemented by one integrated circuit (IC) which includes functions equivalent to those of the rectifier circuit and the DC-DC converter.

The light circuit 150 causes the light sources 110 to emit light based on the lighting control signals output from the control unit 130. More specifically, the light circuit 150 is an LED driver IC, and is mounted on the board 185*a* (or the board 185*b*). The light circuit 150 may be implemented as one of functions of the wireless communication control unit 125 (control unit 130).

The globe 210 is a substantially hemispherical, light-transmissive cover for allowing the light emitted by the light sources 110 to exit the lamp.

The case 230 has openings at both ends, and is located between the globe 210 and the base 220. The case 230 is composed of a substantially circular truncated cone material having a substantially cylindrical shape which gradually decreases in diameter from the globe 210 side toward the base 220 side.

The base 220 is a power receiving unit for receiving AC power at two contacts, and is attached to the socket 204*a* of the lighting fixture 203. The base 220 is, for example, a screw type Edison base (E type).

The circuit case 240 is composed of an insulator, and is typically a resin. The circuit case 240 houses the board 185*a* on which the power supply circuit 140, the light circuit 150, and the control unit 130 are mounted. The circuit case 240 also houses the board 185*c* on which the receiving unit 120 is mounted, and partially houses the board 185*b* on which the light sources 110 are mounted. The board 185*b* may have a ring shape which surrounds the circuit case 240.

The external control device 250 is a remote controller of the lighting device 100, and transmits a control signal or a test signal to the receiving unit 120 of the lighting device 100 in response to a user operation. The frequency band of the wireless communication performed by the external control device 250 is UHF and SHF in a similar manner to the receiving unit 120, but may be other than UHF and SHF.

The control signal is a signal for normally operating the lighting device 100. More specifically, the control signal is a signal for, for example, turning on and off the lighting device 100, and adjusting light or color of the lighting device 100.

Next, a description is given of operations of the lighting device 100.

The main function of the lighting device 100 (function in a normal mode) is to be turned on and off in response to a user operation performed on the external control device 250. In other words, in the normal mode, the receiving unit 120 of the lighting device 100 receives a control signal from the external control device 250, and the control unit 130 causes each light source 110 to emit light according to the control signal received by the receiving unit 120.

On the other hand, the secondary function of the lighting device 100 (function in the test mode) is to notify the user of quality of the wireless communication performed by the receiving unit 120 (wireless communication control unit 125). This function is a feature of the lighting device 100. Hereinafter, referring to FIG. 4, a specific description is given of the operations of the lighting device 100 in the test mode.

Figure 4:
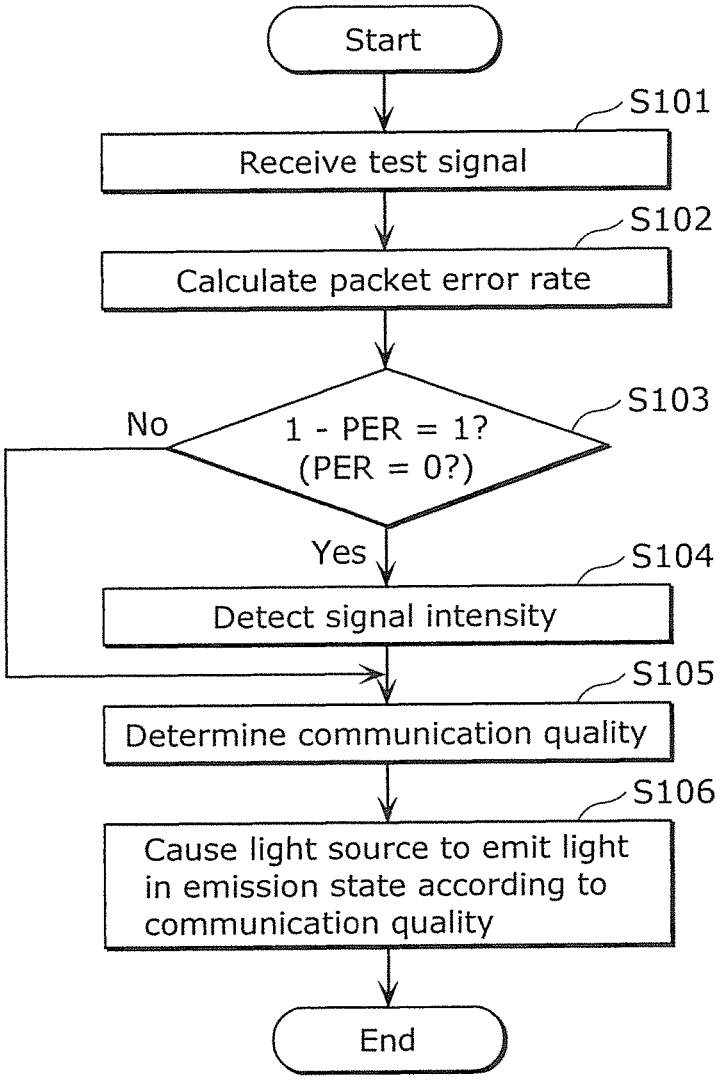
FIG. 4 is a flowchart of operations of a lighting device in a test mode.

FIG. 4 is a flowchart of the operations of the lighting device 100 in the test mode.

First, a user operates the external control device 250 to transmit a test signal to the lighting device 100. More specifically, the receiving unit 120 of the lighting device 100 receives the test signal from the external control device 250 (S101). With this, the lighting device 100 shifts from the normal mode to the test mode.

The test signal refers to a signal different from a control signal, and a signal of a predetermined format, for determining the state of wireless communication. In other words, the test signal is a dedicated signal for calculating the PER.

Next, the control unit 130 calculates the PER of the test signal received by the receiving unit 120 (S102). The PER is obtained based on whether or not a frame included in the test signal has been received and an error has been detected in the received frame.

Next, the control unit 130 determines whether or not the PER is 0 (S103). When the PER is 0, that is, 1-PER is 1 (Yes in S103), the control unit 130 detects the intensity of the test signal (S104).

Here, a description is given of reasons for detection of the intensity of the test signal.

Figure 5:
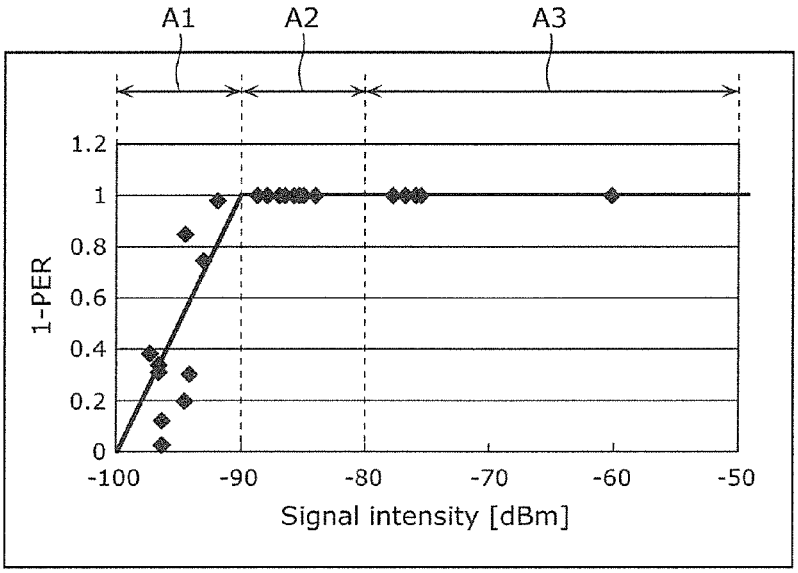
FIG. 5 illustrates a relationship between PER and signal intensity.

FIG. 5 is a diagram for illustrating a relationship between the PER and the signal intensity. FIG. 5 is a plot of experimental data with the vertical axis indicating 1-PER and the horizontal axis indicating the signal intensity.

As illustrated in FIG. 5, in the range where the signal intensity is from −100 dBm to −90 dBm approximately, that is, in the range where the signal intensity is low (range A1), 1-PER tends to increase with an increase in signal intensity. In such a range, PER indicates the communication quality more accurately than the signal intensity does; and thus, the communication quality may be determined based on only the PER.

In the range where 1-PER is 1 (range A2 and range A3), however, only the signal intensity varies. Here, the communication quality in the range A3 is considered to be higher than that in the range A2. This is because if any change is made in the surrounding environment, the range A2 is more likely to be in the state like the range A1.

In other words, in the state where 1-PER is 1, the control unit 130 detects the intensity of the test signal in order to further determine the communication quality. With this, the control unit 130 can determine the communication quality more accurately.

For example, when 1-PER is lower than a predetermined value, the control unit 130 may determine the communication quality to be higher for a higher value of 1-PER, and when 1-PER is higher than or equal to the predetermined value, the control unit 130 may determine the communication quality to be higher for a higher value of the signal intensity. In other words, when the calculated PER is higher than a predetermined value, the control unit 130 may determine the communication quality to be higher for a lower value of the calculated PER, and when the calculated PER is lower than or equal to the predetermined value, the control unit 130 may determine the communication quality to be higher for a higher value of the detected signal intensity. Specifically, the control unit 130 may change the criterion for determining the communication quality according to the PER.

Now, a description is given referring back to the flowchart of FIG. 4.

After Step S104, the control unit 130 determines the communication quality of wireless communication (S104). When 1-PER is 0 in Step S103 (No in S103), too, the control unit 130 performs Step S104.

As described above, the control unit 130 basically determines the communication quality to be higher for a higher value of 1-PER. When 1-PER is 1, the control unit 130 determines the communication quality to be higher for a higher value of the signal intensity.

Lastly, the control unit 130 causes the light sources 110 to emit light such that the emission state is changed according to the determined communication quality (S105).

With the above operations of the lighting device 100, the user can adjust the installation position of the lighting device 100 while checking the emission state of the lighting device 100.

For example, in the case where a plurality of lighting devices 100 are installed in the ceiling with respect to one external control device 250, each lighting device 100 is installed in the ceiling first. Subsequently, the external control device 250 simultaneously transmits test signals to the lighting devices 100 to cause the lighting devices 100 to operate in the test mode. Accordingly, the user can find at a glance one or more of the lighting devices 100 having poor communication states from their emission states.

The user then adjusts the arrangement of the lighting devices 100 having poor communication states. This allows the user to easily install the lighting devices 100 at the positions having high-quality wireless communication.

Furthermore, the user may also adjust the position of the external control device 250 while checking the emission states of the lighting devices 100. Accordingly, the user can easily arrange the external control device 250 at the position which allows all of the lighting devices 100 to have good communication states.

The detection of the signal intensity in Step S104 is a process for determining the communication quality with higher accuracy, and thus, it is not essential. The control unit 130 may determine the communication quality based on at least the calculated packet error rate.

Next, a detailed description is given of a method of changing the emission states of the light sources 110 in the test mode.

Figure 6:
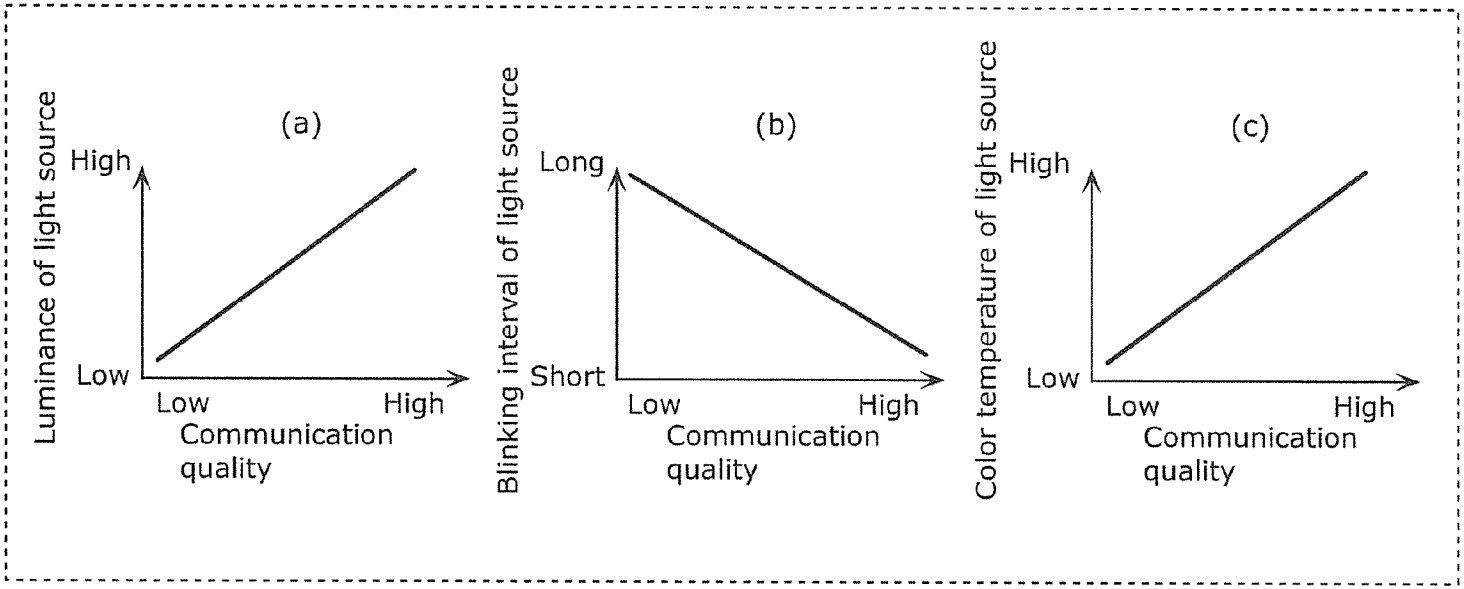
FIG. 6 is a first diagram illustrating a relationship between communication quality and emission state.

FIG. 6 illustrates a relationship between communication quality and emission state.

As illustrated in (a) in FIG. 6, the emission state is, for example, indicated by luminance (luminous flux) of each light source 110. More specifically, for example, the control unit 130 causes the light source 110 to emit light such that the luminance is changed according to the determined communication quality.

In such a case, as illustrated in (a) in FIG. 6, the control unit 130 causes the light source 110 to emit light at higher luminance for a higher value of the communication quality. On the other hand, the control unit 130 may cause the light source 110 at lower luminance for a higher value of the communication quality.

In the case where the control unit 130 outputs a PWM signal, the luminance of the light source 110 is changeable by adjusting current flowing through the light source 110 by changing the duty ratio of the PWM signal. In the case where the light bulb-shaped lamp 200 includes a plurality of light sources 110 as in Embodiment 1, the number of light sources 110 that are caused to emit light may be changed.

As illustrated in (b) in FIG. 6, the emission state is, for example, indicated by a blinking interval of each light source 110. More specifically, for example, the control unit 130 causes the light source 110 to emit light such that the blinking interval is changed according to the determined communication quality.

In such a case, as illustrated in (b) in FIG. 6, the control unit 130 causes the light source 110 to emit light at a shorter blinking interval for a higher value of the communication quality. On the other hand, the control unit 130 may cause the light source 110 to emit light at a longer blinking interval for a higher value of the communication quality.

As illustrated in (c) in FIG. 6, the emission state is, for example, indicated by a color temperature (chromaticity) of the light source 110. More specifically, for example, the control unit 130 causes the light source 110 to emit light such that the color temperature is changed according to the determined communication quality.

In such a case, as illustrated in (c) in FIG. 6, the control unit 130 causes the light source 110 to emit light at a higher color temperature for a higher value of the communication quality. On the other hand, the control unit 130 may cause the light source 110 to emit light at a lower color temperature for a higher value of the communication quality.

The color temperature of the light source 110 is changeable by, for example, covering the light source 110 with an electrochromic filter and controlling light transmittance of the electrochromic filter by voltage application. For the electrochromic filter, for example, nematic liquid crystals containing dichroic dye are used.

In the case where the light bulb-shaped lamp 200 includes a plurality of light sources 110 having different color temperatures, the control unit 130 may change the color temperature by controlling a combination of and the number of the light sources 110 that are caused to emit light.

The emission state is not limited to the example illustrated in FIG. 6. For example, the control unit 130 may cause the light source 110 to emit light such that the light distribution angle is changed according to the determined communication quality.

Furthermore, the control unit 130 may change, according to the determined communication quality, the position of the light source 110 that is caused to emit light or the region in which the light source 110 that is caused to emit light is located.

The control unit 130 may cause the light source 110 to emit light such that the emission state is changed in a stepwise manner according to the communication quality.

Figure 7:
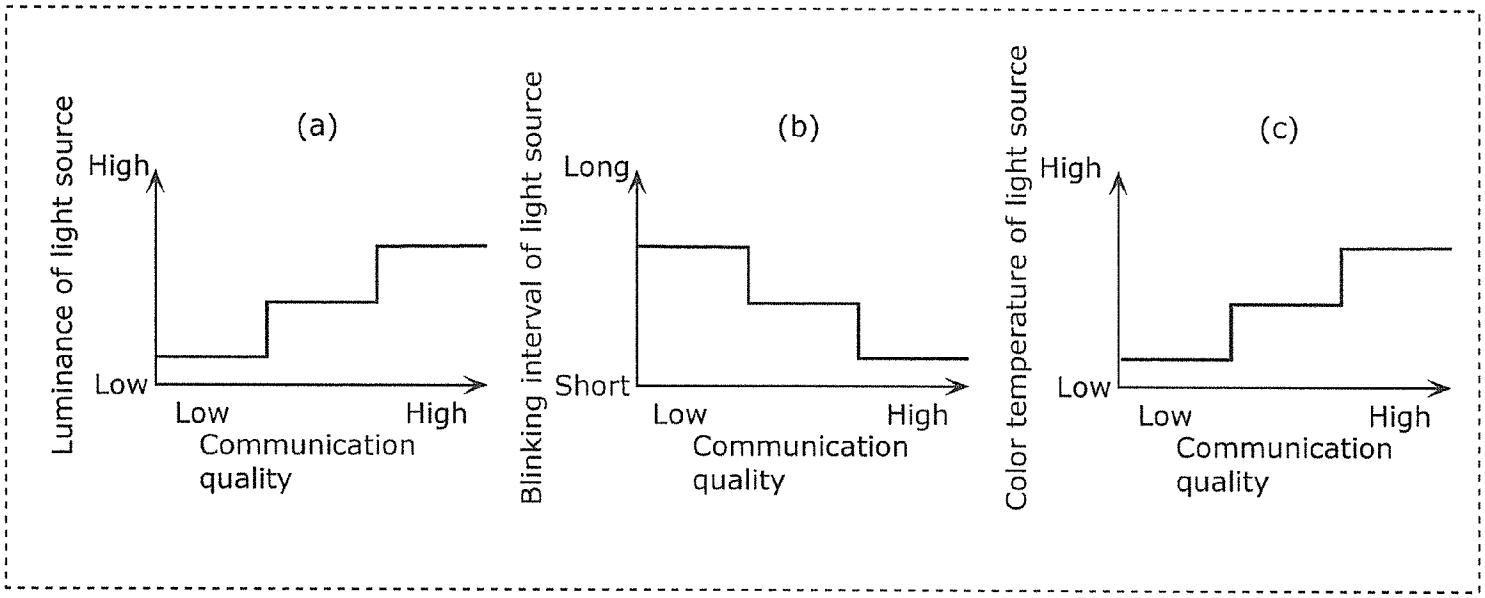
FIG. 7 is a second diagram illustrating a relationship between communication quality and emission state.

FIG. 7 illustrates a relationship between communication quality and the emission state which changes in a stepwise manner.

FIG. 7 illustrates an example where a first threshold value and a second threshold value higher than the first threshold value are set for communication quality values, and the emission state is changed in three steps. Here, it is assumed that the value of the communication quality increases as the communication quality increases.

As illustrated in (a) in FIG. 7, the control unit 130 causes the light source 110 to emit light at first luminance, when the value of the communication quality is lower than the first threshold value. The control unit 130 causes the light source 110 to emit light at second luminance that is higher than the first luminance, when the value of the communication quality is higher than or equal to the first threshold value and lower than the second threshold value. The control unit 130 further causes the light source 110 to emit light at third luminance that is higher than the second luminance, when the value of the communication quality is higher than or equal to the second threshold value. In this case, too, the control unit 130 may cause the light source 110 to emit light at lower luminance for a higher value of the communication quality.

As illustrated in (b) in FIG. 7, the control unit 130 causes the light source 110 to emit light at a first blinking interval when the value of the communication quality is lower than the first threshold value. When the value of the communication quality is higher than or equal to the first threshold value and lower than the second threshold value, the control unit 130 causes the light source 110 to emit light at a second blinking interval that is shorter than the first blinking interval. When the value of the communication quality is higher than or equal to the second threshold value, the control unit 130 causes the light source 110 to emit light at a third blinking interval that is shorter than the second blinking interval. In this case, too, the control unit 130 may cause the light source 110 at a longer blinking interval for a higher value of the communication quality.

As illustrated in (c) in FIG. 7, the control unit 130 causes the light source 110 to emit light at a first color temperature, when the value of the communication quality is lower than the first threshold value. The control unit 130 causes the light source 110 to emit light at a second color temperature higher than the first color temperature, when the value of the communication quality is higher than or equal to the first threshold value and lower than the second threshold value. The control unit 130 further causes the light source 110 to emit light at a third color temperature higher than the second color temperature, when the value of the communication quality is higher than or equal to the second threshold value. In this case, too, the control unit 130 may cause the light source 110 to emit light at a lower color temperature for a higher value of the communication quality.

As described above, by changing the emission state in a stepwise manner according to the communication quality, the user can more easily recognize a change in communication quality.

It may be that at least one threshold value is set. If a threshold value is set to the value of desired communication quality, the user can recognize at a glace whether or not the desired communication quality is being satisfied by checking a change in emission state.

Descriptions have been given of the lighting device 100 according to Embodiment 1.

The lighting device 100 according to Embodiment 1 causes each light source 110 to emit light such that the emission state is changed according to the communication quality in the test mode. With this, the user can adjust the installation position of each lighting device 100 while checking the emission state of the lighting device 100. This allows the user to easily install the lighting device 100 at the position having high-quality wireless communication.

In Embodiment 1, a description has been given of the lighting device 100 which includes the bulb-shaped lamp 200 that is an example of an illumination light source; however, Embodiment 1 may also be implemented as a lighting device including an illumination light source such as a straight tube lamp or a ring-shaped lamp. In addition, Embodiment 1 is also applicable to other illumination light sources, such as an illumination light source with a thin flat structure used for a lighting device such as a downlight or a spot light.

Embodiment 2

In Embodiment 1, the light bulb-shaped lamp 200 in the lighting device 100 includes the wireless communication control unit 125, but it may be that a lighting fixture 203 in the lighting device 100 includes the wireless communication control unit 125.

Figure 8:
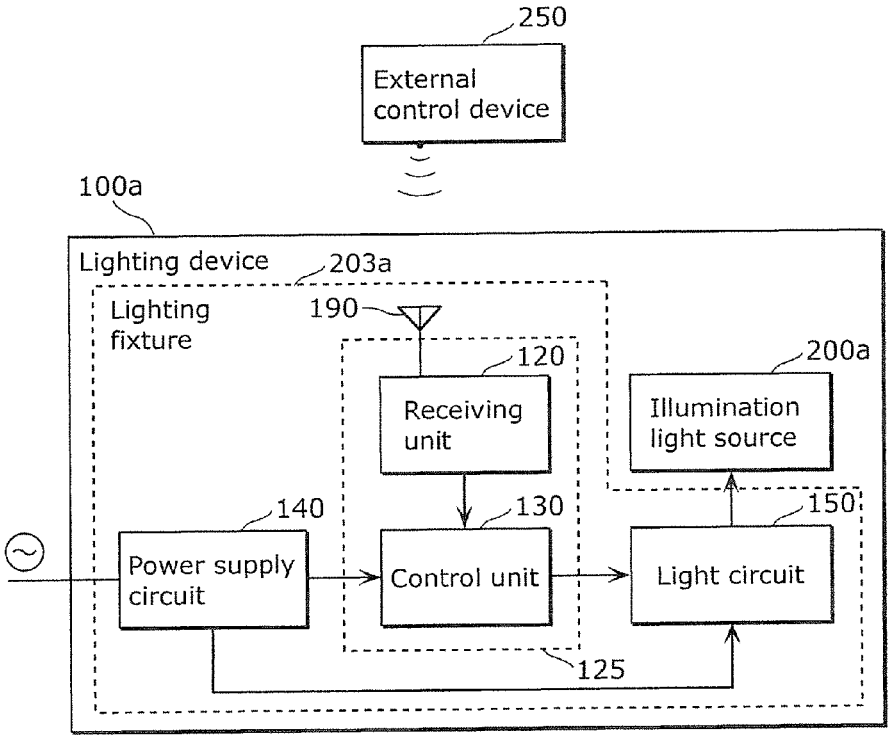
FIG. 8 is a block diagram of a functional configuration of a lighting device which includes a lighting fixture with a wireless communication control unit.

FIG. 8 is a block diagram illustrating a functional configuration of a lighting device in the case where the lighting fixture 203 includes the wireless communication control unit 125. The structural elements in FIG. 8 that are substantially the same as those in FIG. 2 are not described here.

As illustrated in FIG. 8, a lighting device 100*a* includes a lighting fixture 203*a*, an illumination light source 200*a* (light source).

The lighting fixture 203*a* includes a wireless communication control unit 125 (a receiving unit 120 and a control unit 130), a power supply circuit 140, and a light circuit 150.

The illumination light source 200*a* (light source) emits light in response to a supply of DC power from the light circuit 150 included in the lighting fixture 203*a*. In this case, too, the lighting source 200*a* may be, for example, a bulb-shaped lamp as described in Embodiment 1, a straight tube lamp, a ring-shaped lamp, or an illumination light source with a thin flat structure.

In the case where a lighting device with the system configuration as illustrated in FIG. 8 includes a plurality of illumination light sources, the control unit 130 may change the emission state by selectively causing the illumination light sources to emit light. Hereinafter, referring to the drawings, a description is given of such an example.

Figure 9:
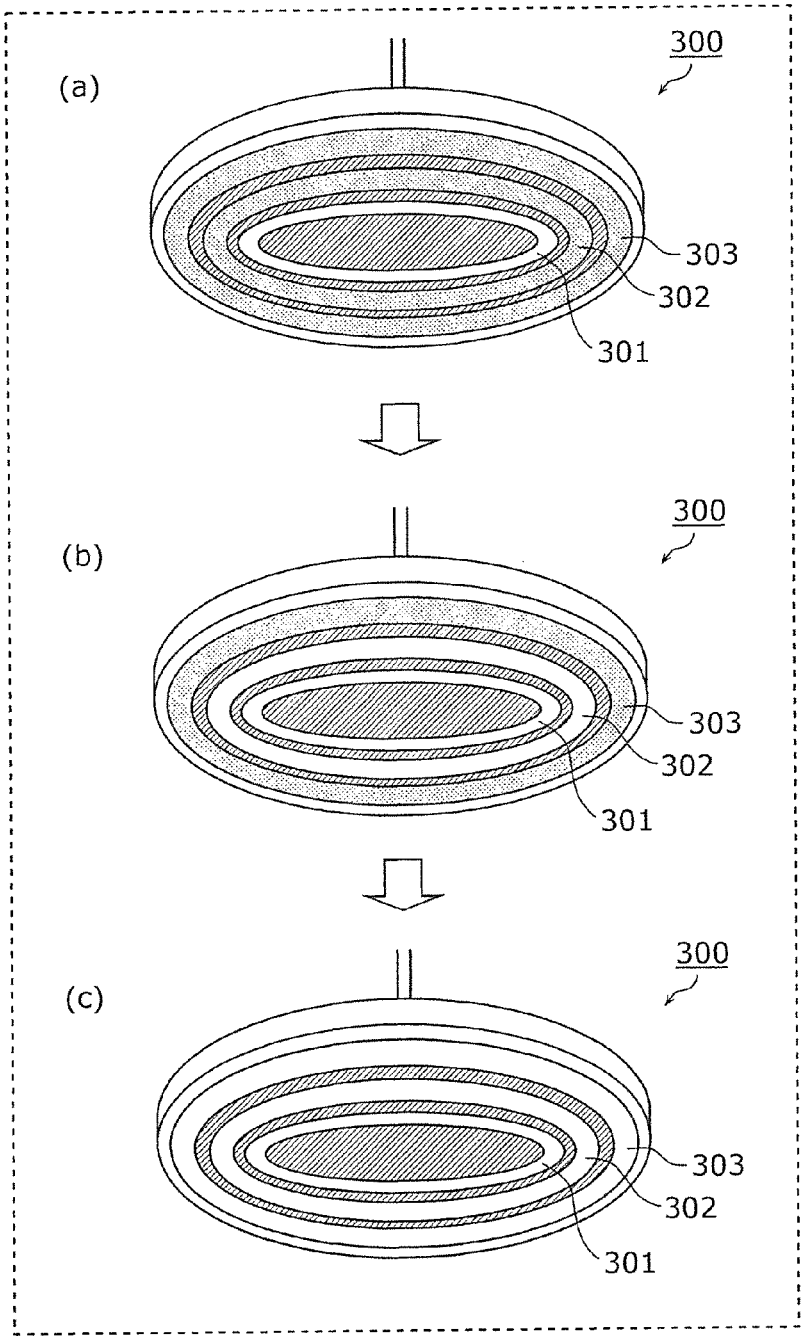
FIG. 9 schematically illustrates a method of changing the emission state of a lighting device which includes a plurality of ring shaped lamps.

FIG. 9 schematically illustrates a method of changing the emission state of a lighting device including a plurality of ring-shaped lamps. In a similar manner to FIG. 7, FIG. 9 illustrates an example where communication quality values includes a first threshold value and a second threshold value that is higher than the first threshold value and the emission state is changed in three steps. Here, the value of the communication quality increases as the communication quality increases.

The lighting device 300 illustrated in FIG. 9 includes a first ring-shaped lamp 301, a second ring-shaped lamp 302, and a third ring-shaped lamp 303. In other words, the lighting device 300 includes three ring-shaped lamps (illumination light sources).

The second ring-shaped lamp 302 is provided outside the first ring-shaped lamp 301 so as to surround the first ring-shaped lamp 301. The third ring-shaped lamp 303 is provided outside the second ring-shaped lamp 302 so as to surround the second ring-shaped lamp 302.

With respect to the lighting device 300 having such a structure, the control unit 130, for example, increases, according to the communication quality, the number of ring-shaped lamps that are caused to emit light by sequentially causing the ring-shaped lamps to emit light from the innermost ring-shaped lamp. More specifically, the control unit 130 changes the number of ring-shaped lamps that are caused to emit light, according to the determined communication quality.

More specifically, as illustrated in (a) in FIG. 9, the control unit 130 causes only the first ring-shaped lamp 301 to emit light when the value of the communication quality is lower than the first threshold. Subsequently, as illustrated in (b) in FIG. 9, the control unit 130 causes the second ring-shaped lamp 302 in addition to the first ring-shaped lamp 301 to emit light when the value of the communication quality is higher than or equal to the first threshold and lower than the second threshold value. As illustrated in (c) in FIG. 9, the control unit 130 causes the third ring-shaped lamp 303 in addition to the first ring-shaped lamp 301 and the second ring-shaped lamp 302 to emit light when the value of the communication quality is higher than or equal to the second threshold value.

For example, in the case where the first ring-shaped lamp 301, the second ring-shaped lamp 302, and the third ring-shaped lamp 303 are illumination light sources having different color temperatures, the control unit 130 may cause one of the three ring-shaped lamps to emit light according to the communication quality.

A similar control may be performed on a lighting device including a plurality of straight tube lamps.

Figure 10:
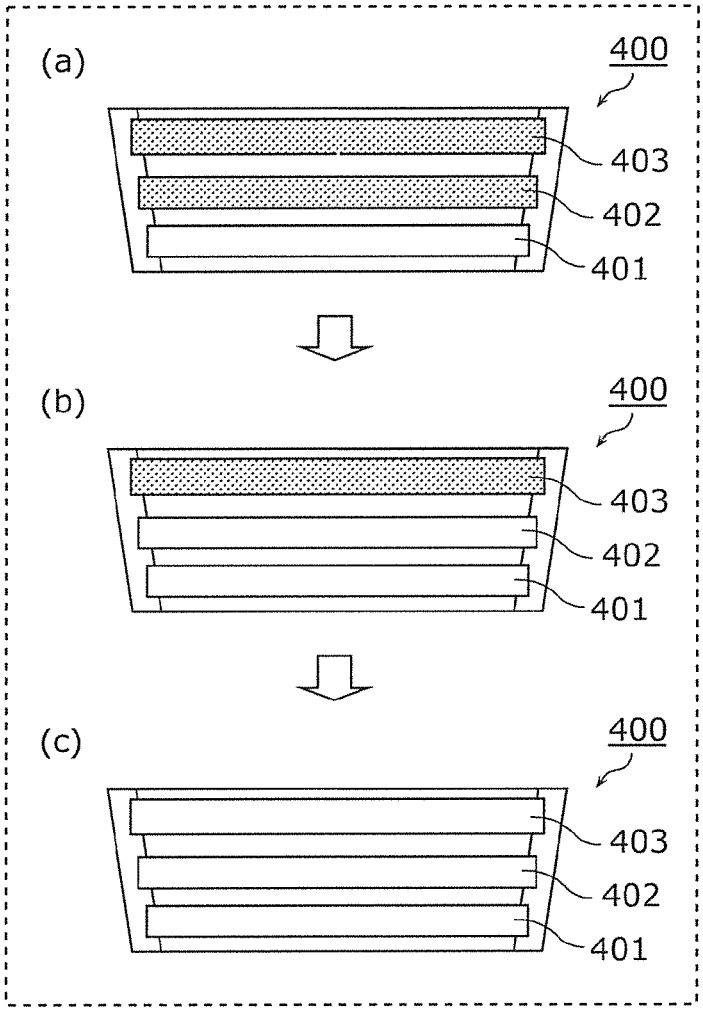
FIG. 10 schematically illustrates a method of changing the light emitting state of a lighting device which includes a plurality of straight tube lamps.

FIG. 10 schematically illustrates a method of changing the emission state of a lighting device including a plurality of straight tube lamps. In the example in FIG. 10, thresholds that are substantially the same as those in FIG. 9 are set, and the emission state is changed in three steps. Here, the value of the communication quality increases as the communication quality increases.

A lighting device 400 illustrated in FIG. 10 includes a first straight tube lamp 401, a second straight tube lamp 402, and a third straight tube lamp 403. In other words, the lighting device 400 includes three straight tube lamps (illumination light sources).

The first straight tube lamp 401, the second straight tube lamp 402, and the third straight tube lamp 403 are arranged in this order side by side. The straight tube lamps are arranged in parallel.

In the lighting device 400 having such a structure, the control unit 130, for example, increases, according to the communication quality, the number of straight tube lamps that are caused to emit light by sequentially causing the straight tube lamps to emit light from the one located at the end. More specifically, the control unit 130 changes the number of straight tube lamps that are caused to emit light, according to the determined communication quality.

More specifically, as illustrated in (a) to (c) in FIG. 10, the first straight tube lamp 401, the second straight tube lamp 402, and the third straight tube lamp 403 are caused to emit light in this order.

As described referring to FIG. 9 and FIG. 10, the control unit 130 changes the emission states of the lighting device 300 and the lighting device 400 by changing, according to the communication quality, the number of illumination light sources that are caused to emit light. This allows a user to more easily recognize a change in communication quality. Furthermore, control for selectively causing illumination light sources to emit light is implementable by adding a relatively simple change to a circuit in a conventional lighting device.

The number of illumination light sources that are caused to emit light by the control unit 130 and the positions of the illumination light sources within the lighting fixture are not limited to the examples above. They may be other than the above as long as the control unit 130 selectively causes the illumination light sources to emit light according to the communication quality so that the user can distinguish the communication quality.

Other Embodiment

Descriptions have been given of Embodiment 1 and Embodiment 2, but the present invention is not limited to these embodiments.

For example, the control unit 130 may change a portion of one illumination light source (light source) which emits light, according to the determined communication quality.

Figure 11:
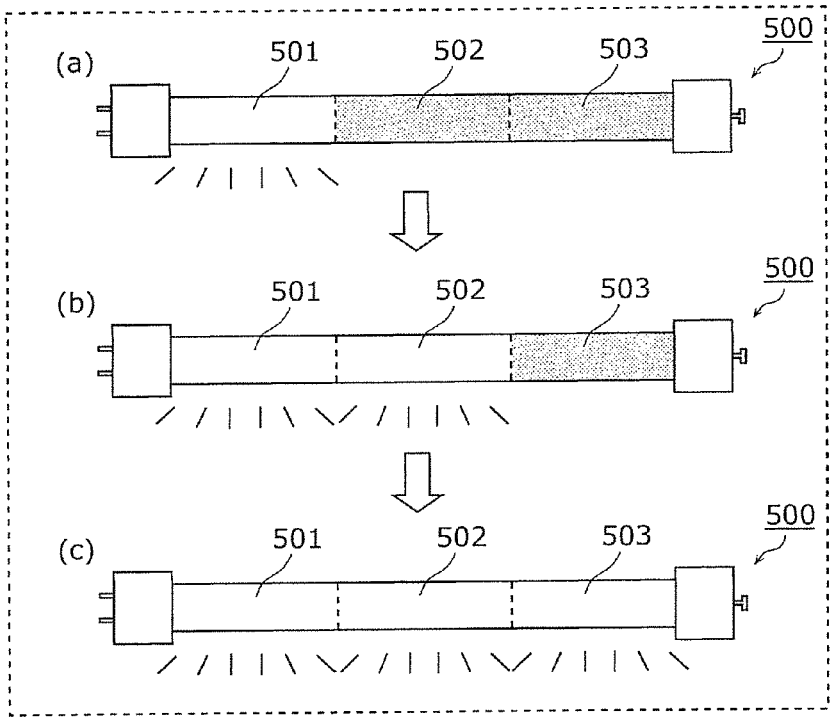
FIG. 11 schematically illustrates an example where a portion of one illumination light source which emits light is changed according to the communication quality.

FIG. 11 schematically illustrates an example where a portion of one illumination light source which emits light is changed according to the communication quality. FIG. 11 illustrates only the illumination light source, but omits illustration of the lighting fixture.

An illumination light source 500 is a straight tube LED lamp. In a similar manner to Embodiment 1, the illumination light source 500 includes a wireless communication control unit 125 (a receiving unit 120 and a control unit 130), a power supply circuit 140, and a light circuit 150. A description is given below where the illumination light source 500 is divided, from one end in a longer direction, into three regions that are a first region 501, a second region 502, and a third region 503. The emission state of the illumination light source 500 is changed according to the threshold values in a similar manner to FIG. 9.

The illumination light source 500 includes, inside, a board elongated in the longitudinal direction of the illumination light source 500. The board is provided, thereon, with a line of LEDs (light-emitting elements) arranged along the longitudinal direction of the board. In the illumination light source 500, the light circuit 150 has a circuit configuration where a semiconductor switch or the like can selectively cause LEDs in the first region 501, LEDs in the second region 502, and LEDs in the third region to emit light.

With such a circuit configuration, the control unit 130 changes the portion of the lighting source 500 which emits light, according to the determined communication quality.

More specifically, as illustrated in (a) in FIG. 11, the control unit 130 causes only the first region 501 to emit light when the value of the communication quality is lower than the first threshold. Subsequently, as illustrated in (b) in FIG. 11, the control unit 130 causes the second region 502 in addition to the first region 501 to emit light when the value of the communication quality is higher than or equal to the first threshold and lower than the second threshold value. As illustrated in (c) in FIG. 11, the control unit 130 causes the third region 503 in addition to the first region 501 and the second region 502 to emit light when the value of the communication quality is higher than or equal to the second threshold value.

More specifically, the control unit 130 performs control such that the portion of the illumination light source 500 which emits light increases from one end to the other end of the lighting source 500 as the communication quality increases. Accordingly, one illumination light source 500 is used as if it is an indicator, so that a user can intuitively recognize the communication quality. The control unit 130 may perform control such that the portion of the illumination light source 500 which emits light decreases from one end to the other end of the illumination light source 500 as the communication quality increases.

In Embodiment 1, the control unit 130 determines the communication quality based on PER and signal intensity, but the control unit 130 may further determine the communication quality based on the number of times the test signals are properly received by the receiving unit 120.

In such a case, when the receiving unit 120 receives a test signal, the receiving unit 120 further receives test signals plural times. When the receiving unit 120 receives the test signals, the control unit 130 further determines the communication quality taking into account the number of times the test signals are properly received by the receiving unit 120. Whether or not the receiving unit 120 properly received each test signal can be determined by whether or not the PER of the test signal is lower than a predetermined value.

More specifically, for example, when the rate of proper receipt of the test signals (the number of times the test signals are properly received) is lower than a predetermined value even if the communication quality is determined to be high based on the PER or signal intensity, the control unit 130 considers the communication quality to be low.

Experiments have shown that the quality of wireless communication changes over time. Hence, checking reproducibility of the communication quality leads to more reliable determination of the communication quality.

The lighting device may further include a terminal for a user to obtain information indicating the communication quality determined by the control unit 130. More specifically, for example, the control unit 130 outputs, to the terminal, DC voltage corresponding to the determined communication quality, as information indicating the communication quality.

With this, a user can check the value of the communication quality in more details, by connecting an external device, such as a tester, to the terminal.

In Embodiments 1 and 2, the control unit 130 calculates PER, determines the communication quality based on the PER, and causes a light source to emit light such that the emission state is changed according to the determined communication quality. Here, part of such functions of the control unit 130 may be implemented as a function of the light circuit 150.

For example, it maybe that the control unit 130 calculates PER, and the light circuit 150 determines the communication quality based on the PER calculated by the control unit 130, and causes a light source to emit light such that the emission state is changed according to the determined communication quality. More specifically, the control unit included in the light circuit 150 may include part of the functions of the control unit 130.

As described, the control unit 130 need not necessary be composed of one element, but may be composed of plural elements.

In the test mode, a user might look at the light source straight in the eye, which is different from the normal mode. Hence, it is desirable that the maximum luminance of the light source in the test mode is lower than that in the normal mode. This increases safety for the user in the test mode.

In Embodiments 1 and 2, an SMD light-emitting element and various illumination light sources are described as examples of light sources, but the light source may be the one used for light emission of the lighting device in a normal mode. In other words, examples of the light source include a so-called night-light.

In Embodiments 1 and 2, each structural element may be configured by dedicated hardware or may be implemented by executing a software program suitable for the structural element. Each structural element may be implemented by a program executing unit, such as a CPU or a processor, reading out a software program recorded on a recording medium such as a hard disk or a semiconductor memory, and executing the program.

Furthermore, the present invention may also be implemented by a lighting system including a lighting device and an external control device. The present invention may also be implemented as an illumination light source or a lighting fixture.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

The invention claimed is:

1. A lighting device comprising:

a light source;

a receiving unit configured to receive a control signal from outside the lighting device via wireless communication; and a control unit configured to cause the light source to emit light according to the control signal received by the receiving unit;

wherein, when the receiving unit receives, from the outside the lighting device via the wireless communication, a test signal different from the control signal and for determining a state of the wireless communication, the control unit is configured to calculate a packet error rate of the test signal and to cause the light source to emit light such that an emission state is changed according to a communication quality of the wireless communication determined based on at least the calculated packet error rate.

2. The lighting device according to claim 1, wherein, when the receiving unit receives the test signal, the control unit is further configured to detect a signal intensity of the test signal, and the communication quality is determined based on the packet error rate calculated by the control unit and the signal intensity detected by the control unit.

3. The lighting device according to claim 2, wherein, when the packet error rate calculated by the control unit is higher than a predetermined value, the communication quality is determined to be higher for a lower value of the calculated packet error rate, and when the packet error rate calculated by the control unit is lower than or equal to the predetermined value, the communication quality is determined to be higher for a higher value of the detected signal intensity.

4. The lighting device according to claim 2, wherein, when the calculated packet error rate is higher than 0, the communication quality is determined to be higher for a lower value of the packet error rate calculated by the control unit, and when the packet error rate calculated by the control unit is 0, the communication quality is determined to be higher for a higher value of the detected signal intensity.

5. The lighting device according to claim 1, wherein, when the receiving unit receives the test signal, the receiving unit is configured to further receive the test signal plural times, and the communication quality is further determined based on a total number of times the test signal is properly received by the receiving unit.

6. The lighting device according to claim 1, wherein the emission state is indicated by a luminance of the light source, and the control unit is configured to cause the light source to emit light such that the luminance is changed according to the communication quality.

7. The lighting device according to claim 1, wherein the emission state is indicated by a blinking interval of the light source, and the control unit is configured to cause the light source to emit light such that the blinking interval is changed according to the communication quality.

8. The lighting device according to claim 1, wherein the emission state is indicated by a color temperature of the light source, and the control unit is configured to cause the light source to emit light such that the color temperature is changed according to the communication quality.

9. The lighting device according to claim 1, wherein the control unit is configured to cause the light source to emit light such that the emission state is changed in a stepwise manner according to the communication quality.

10. The lighting device according to claim 1, further comprising a plurality of the light sources, wherein the emission state is indicated by a total number of the light sources that are caused to emit light, and the control unit is configured to change, according to the communication quality, the total number of the light sources that are caused to emit light.

11. The lighting device according to claim 1, wherein the control unit is configured to change, according to the communication quality, a portion of the light source which emits light.

12. The lighting device according to claim 11, wherein the light source is a straight tube light-emitting diode (LED) lamp, and the control unit is configured to increase or decrease the portion of the light source which emits light, from one end to the other end of the light source, as the communication quality increases.

13. The lighting device according to claim 1, wherein the control unit is configured to cause the light source to emit light by outputting a pulse width modulation (PWM) signal.

14. The lighting device according to claim 1, further comprising a terminal for a user to obtain information indicating the communication quality.

15. The lighting device according to claim 14, wherein the control unit is configured to output a DC voltage according to the communication quality to the terminal as the information indicating the communication quality.

16. The lighting device according to claim 1, wherein the receiving unit is configured to receive the control signal and the test signal via the wireless communication of an ultra high frequency (UHF) band and a super high frequency (SHF) band.

17. A method of controlling a lighting device which externally receives a control signal via wireless communication and emits light according to the received control signal, the method comprising, when the lighting device receives, via the wireless communication, a test signal different from the control signal and for determining a state of the wireless communication:

calculating a packet error rate of the test signal received by the lighting device; and causing the lighting device to emit light such that an emission state is changed according to a communication quality of the wireless communication determined based on at least the calculated packet error rate.

18. A lighting system comprising:

a lighting device; and an external control device, wherein the lighting device includes:

a light source;

a receiving unit configured to receive a control signal from the external control device via wireless communication; and a control unit configured to cause the light source to emit light according to the control signal received by the receiving unit, wherein, when the receiving unit receives, from the external control device via the wireless communication, a test signal different from the control signal and is for determining a state of the wireless communication, the control unit is configured to calculate a packet error rate of the test signal and to cause the light source to emit light such that an emission state is changed according to a communication quality of the wireless communication determined based on at least the calculated packet error rate.

* * * * *